United States Patent [19]

Feterl

[11] Patent Number: 4,457,746

[45] Date of Patent: Jul. 3, 1984

[54] APPARATUS FOR CENTRIFUGAL SEPARATION

[75] Inventor: Leon G. Feterl, Salem, S. Dak.

[73] Assignee: Core Industries, Inc., Bloomfield Hills, Mich.

[21] Appl. No.: 456,513

[22] Filed: Jan. 7, 1983

[51] Int. Cl.[3] ..... B04B 3/06

[52] U.S. Cl. ..... 494/47; 494/52; 494/83; 494/84; 209/144

[58] Field of Search ..... 494/43, 44, 46, 47, 494/51, 50, 52, 67, 83, 84; 209/144, 148

[56] References Cited

U.S. PATENT DOCUMENTS

| | | | |
|---|---|---|---|
| 541,769 | 6/1895 | Macomber | 209/148 |
| 547,609 | 10/1895 | Jessen | 209/148 |
| 560,629 | 5/1896 | Peck | 494/27 |
| 3,590,995 | 7/1971 | Truckenbrod | 209/148 |
| 4,350,282 | 9/1982 | Dudrey | 494/84 |

*Primary Examiner*—Robert W. Jenkins

*Attorney, Agent, or Firm*—Williamson, Bains, Moore & Hansen

[57] ABSTRACT

A centrifugal separator for grain and like particulate material utilizing a rotatably driven separator bowl having an outwardly inclined peripheral wall, in combination with a vibrator. Vibration and centrifugal force acting on material deposited in the rotating bowl cause it to move outwardly towards the bowl periphery and up the aforesaid inclined wall for selective discharge of relatively heavy and light particles at vertically spaced exit zones formed by a guide baffle assembly adjacent the upper periphery of the inclined wall.

12 Claims, 4 Drawing Figures

APPARATUS FOR CENTRIFUGAL SEPARATION

BACKGROUND OF THE INVENTION

Rotary driven devices for separating granular or particulate materials into different weight components by centrifugal force are well known. See, for example, U.S. Pat. No. 3,590,995 issued to Lyle F. Truckenbrod. Such apparatus utilizing vibrating separator bowls has been utilized as disclosed in U.S. Pat. No. 560,629 to O. B. Peck.

A centrifugal grain separator incorporating a rotary drum having outwardly inclined side walls in combination with a surrounding, outer casing having similarly inclined walls is disclosed in U.S. Pat. No. 541,769 issued to L. W. Macomber. Relatively heavy grain particles are thrown by centrifugal force over the top of the rotary drum and into an annular collection passage formed by the outer casing. Relatively light foreign particles are discharged at the top of the apparatus. The Truckenbrod and Macomber patents, as well as U.S. Pat. No. 547,609 issued to J. Jessen, rely on air as a fluidizing medium to assist in the movement and separation of particles. Peck uses a liquid for a similar purpose.

This invention is directed to a centrifugal separator which effectively separates light and heavy weight particles in a relatively compact and simple apparatus without the use of any fluidizing medium.

BRIEF SUMMARY OF THE INVENTION

The centrifugal separator of this invention is particularly characterized by a rotary bowl which is vibrated in such a way as to provide effective and convenient separation and collection of relatively heavy and light weight particles at separate, vertically spaced exit zones. The primary, intended application is for the separation and cleaning of grain.

This basic objective is achieved by providing, in combination with vibrating means for the separator bowl, an outwardly inclined, annular guide baffle extending down inside the bowl and projecting above the top of the inclined peripheral wall of the bowl so as to define at the top of the baffle a first exit zone for light weight particles. The bottom of the guide baffle is spaced radially inwardly from the top end of the outwardly inclined peripheral wall of the separator bowl; and a separator ring extends outwardly from the guide baffle and terminates inside of the peripheral wall of the bowl to define therewith a second, lower exit zone for relatively heavy particles.

In the preferred embodiment, the guide baffle is supported from the inclined peripheral wall of the separator bowl at a predetermined elevation so as to position the aforesaid separator ring below the upper extremity of the bowl in a generally horizontal plane where it will form the second, lower exit zone as an annular opening of desired size.

The bowl is vibrated, as it rotates, in such a way as to maintain granular material deposited in the center of the bowl in a fluidized state. This is preferably accomplished by the use of an unbalanced disc positioned within the separator bowl and rotated at a predetermined speed greatly in excess of that at which the bowl is rotated. The relative rotary speeds of the separator bowl and the vibrator, and the inclination of the peripheral wall of the separator bowl, are such that material particles deposited in the middle of the bowl will be moved by centrifugal force and vibration radially outwardly towards the bowl peripheral wall. These forces, acting in conjunction with that of additional material continuously fed into the bowl from its top and pushing outwardly, cause the material to ascend the inclined peripheral wall. The heavy material, normally the desired grain, discharges at the aforesaid lower exit zone into a first, peripheral collection chamber. The chaff, foreign particles, and other relatively light weight material will accumulate on top of the heavy particles along the bowl peripheral wall, under the aforesaid separator ring, and thence move upwardly along the inclined guide baffle above the bowl to the upper exit zone.

These and other objects and advantages of the invention will be readily understood as the following description is read in conjunction with the accompanying drawings, wherein like reference numerals have been used to designate like elements throughout the several views.

DESCRIPTION OF THE PREFERRED EMBODIMENT

Figure 1:
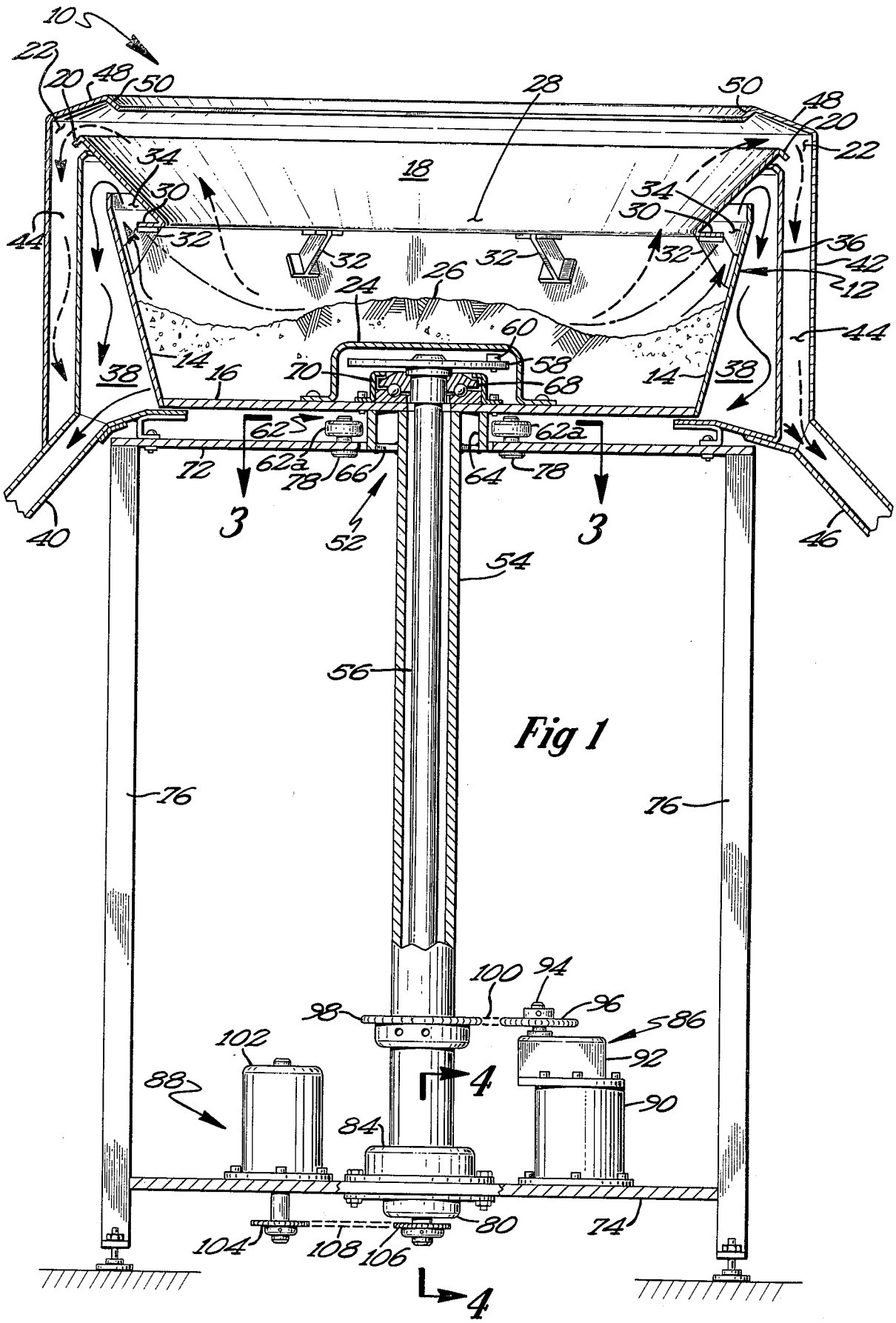
FIG. 1 is an elevation view, partially in section, of the centrifugal separator apparatus of this invention.

With reference to the embodiment of the invention illustrated in FIGS. 1 through 4 inclusive, the reference numeral 10 generally designates the centrifugal separator. The centrifugal separator as disclosed herein may be used to separate various particulate materials into light and heavy components. For example, the separator operates to separate wheat from wild oats intermixed therewith, as well as to separate wheat from chaff and other undesired foreign matter. Although such agricultural applications are contemplated as the main function of the apparatus, it will readily be understood that the centrifugal separator may be utilized to separate a large variety of particulate materials into different weight elements.

According to the present convention, there is provided a rotary, separator bowl 12 having a peripheral wall 14 which inclines upwardly and outwardly from a base or bottom wall 16. An annular guide baffle 18 is mounted at an elevated position above the bottom of rotary separator bowl 12. Guide baffle 18 is peripherally sloped, and is also inclined upwardly and outwardly as shown in FIG. 1. Preferably, guide baffle 18 is circular in shape, and is supported generally concentric with rotary bowl 12. Guide baffle 18 projects above the top of inclined peripheral wall 14 of rotary bowl 12, and terminates at a top peripheral lip or edge 20 which defines a first peripheral exit zone 22 for relatively light weight particles.

Figure 2:
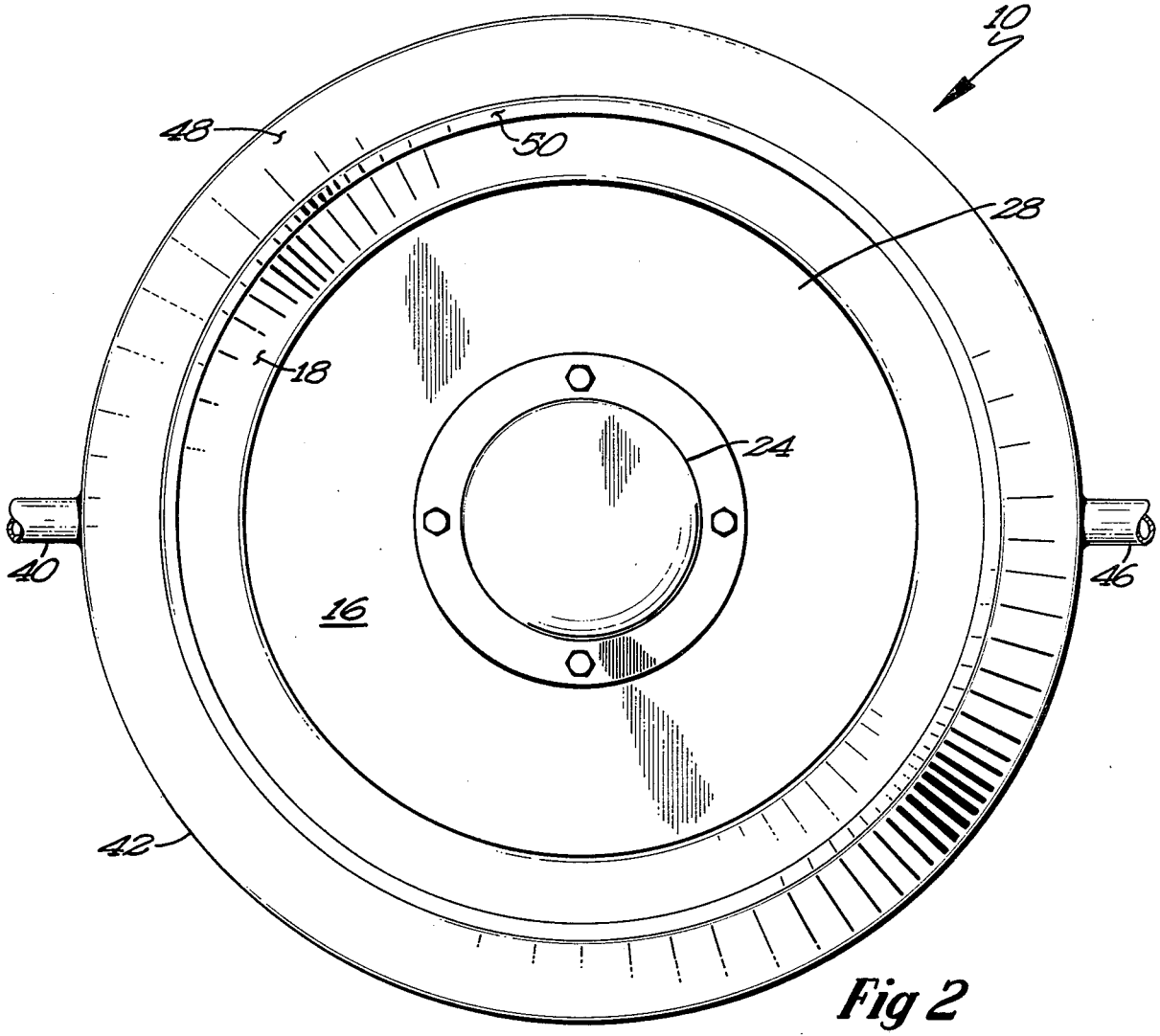
FIG. 2 is a top, plan view of the apparatus of FIG. 1.

Fastened to bottom wall 16 of separator bowl 12, substantially centrally thereof, is a dome member 24. Dome 24 serves several purposes as hereinafter set forth, one of which is to assist in the distribution of particulate material to the outside of rotary bowl 12. Particulate material 26 is normally introduced overhead from an outside source into separator bowl 12 through the central opening 28 in guide baffle 18, and deposited on top of dome 24 as depicted in FIGS. 1 and 2. Centrifugal force generated during the rotation of bowl 12 causes the particulate material to move outwardly to the periphery of the bowl, the details of the particle movement during separation being set forth hereinafter in more detail.

A separator ring 30 is attached horizontally to the peripherally sloped annular baffle 18 as by welding. A plurality of circumferentially spaced brackets 32 are connected between the inner face of inclined side wall 14 of separator bowl 12 and separator ring 30, either by removable fasteners (not shown) or by welding. Brackets 32 are located on inclinded, peripheral wall 14 of separator bowl 12 so as to support guide baffle 18 at a predetermined, elevated position above bottom wall 16 of separator bowl 12. Separator ring 30 extends outwardly from guide baffle 18 and terminates inwardly from inclined peripheral wall 14 of separator bowl 12 in spaced apart relation thereto so as to define an annular opening 34. Opening 34 comprises a second, peripheral exit zone below the first exit zone 22 through which lighter particles are discharged. As is shown in FIG. 1, the lower end of annular guide baffle 18 extends below the upper extremity of inclined wall 14 of separator bowl 12; and, separator ring 30 is supported by brackets 32 at an elevation where it will be positioned below the upper extremity of inclined wall 14. This arrangement insures the proper flow of heavier particles through annular exit zone 34 upwardly along the outside, underface of guide baffle 18 and thence over the top, peripheral edge of side wall 14 of separator bowl 12.

A first circular collector housing 36 encircles separator bowl 12 in outwardly spaced relation to its inclined side wall 14, and defines therewith a first, annular collection chamber 38 for heavy particles. A chute 40 is connected to the bottom of collection chamber 38 for the discharge of heavy particles. A second, circular collector housing 42 extends around the outside of housing 36, and defines therewith a second, annular collection chamber 44 for relatively light weight particles exiting through upper discharge zone 22. A second discharge chute 46 is attached to the bottom of chamber 44. Outer collector housing 42 terminates at its upper end in an inwardly extending, annular ring 48 overlying the top periphery of guide baffle 18 and defining therewith upper exit zone 22. Inwardly turned segment 48 of outer collector housing 42 has a downwardly turned lip 50 which assists in guiding material into separator bowl 12.

The particulate material 26 in the rotary bowl 12 is transferred to the periphery of the rotary bowl 12 in a fluid state by rotary drive and vibrating means having a dual shaft arrangement generally noted as 52. This dual shaft arrangement 100 includes a first shaft 54 defining a heavy wall tubing. A second solid shaft 56 passes longitudinally through the first shaft 54 concentric therewith. Both shafts 54 and 56 preferably rotate in the same direction with the second shaft 56 being rotated much faster than the first shaft 54. The first shaft 54 is rotated at a range between 50 and 200 r.p.m., and the second shaft 56 is rotated at a range between 1500 and 2000 r.p.m. Rotary vibrating means in the form of an unbalanced disc 58 is secured to the top of the second shaft 56. The disc 58 carries a weight 60 attached to its peripheral surface which imbalances it and sets up vibrations transmitted to rotary bowl 12. Unbalanced disc 58 is positioned within separator bowl 12 and is covered by dome 24.

Figure 3:
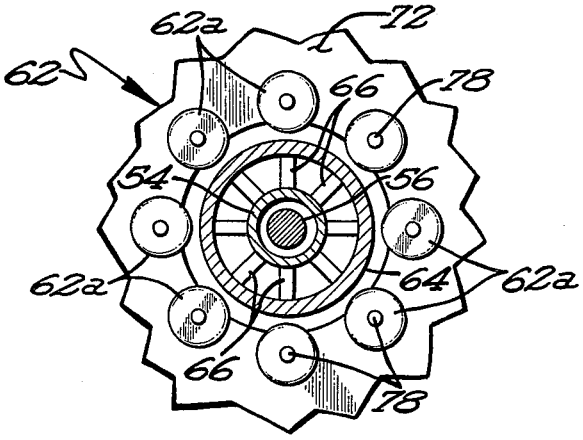
FIG. 3 is a horizontal section view of a portion of the drive apparatus taken along lines 3—3 of FIG. 1.

A roller bracing means 62 for the tubular shaft 54 and separator bowl 12 loosely abuts a collar 64 affixed to the underside of bowl bottom wall 16. The collar 64 is secured to the first shaft 54 for rotation therewith by means of a plurality of radial retaining spokes 66. The attachment of collar 64, as well as the top end of shaft 54, to the separator bowl 12 thereby allows the separator bowl to rotate at the predetermined speed of the first shaft 54. In the preferred embodiment, the roller bracing means 30 may take the form of a plurality of rubber wheels **62*a* disposed in a circular pattern around the outside of collar 64. As shown in FIG. 3, the roller wheels 62*a* should abut the collar 64 loosely, as a tight abutment creates a dampening effect on the vibration of the bowl 12**.

The solid second shaft 56 is journaled at its upper end in its rotating position by means of a ball bearing 68. The bearing 68 is aligned to hold the solid second shaft 56 in rotational relationship by means of a bracket arrangement 70. The bracket 70 is attached as shown to the base 16 of the rotary bowl 12 by fastening means.

Figure 4:
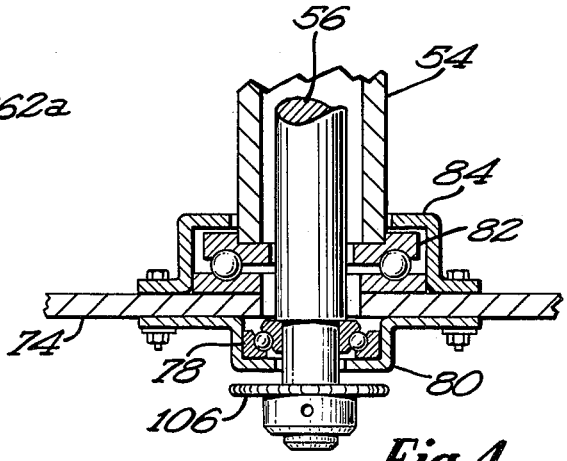
FIG. 4 is a vertical section view of a portion of the drive shaft and bearing assembly taken along lines 4—4 of FIG. 1.

As shown in FIG. 1, the centrifugal separator assembly 10 is supported above the ground by means of a frame assembly having an upper, annular deck 72, lower annular base plate 74, and upright side frame posts 76. The upper frame deck 72 extends horizontally between the roller bracing means 62 and side frame posts 76. Rollers **62*a* are rotatably supported on the inner periphery of annular deck 72 by roller pins 78. The lower frame plate 74 extends horizontally between the bottom end of the second shaft 56 and the side frame posts 76. The lower frame plate 74 is apertured for the passage of shaft 56 therethrough. In this configuration the frame assembly provides sturdy support for the centrifugal separator 10 at an elevated location so that particulates 26 may be transported from an outside source by a conveyor or other suitable overhead transport means and deposited in the rotary bowl 12 for separation. As shown in FIG. 4, the lower ends of both the first shaft 54 and the solid second shaft 56 are journaled by means of bearing arrangements. The solid second shaft 56 is positioned in rotatable relationship by means of the ball bearing 78. Bearing 78 is aligned and held in place by means of the bracket 80. Bracket 80 is fastened to the underside of the lower frame plate 74. The bearings 78 and 68 cooperate to journal the solid second shaft 56 in its desired relationship to tubular shaft 56 during rotation. The first tubular shaft 54 is journaled at its bottom end by means of ball bearing 82. The size of bearing 82 is determined by the diameter of the first shaft 54. The bearing 82 is aligned and held in place by means of bracket 84 fastened to the upper face of lower frame member 74**.

The separator assembly includes a first shaft driving means 86 and a second shaft driving means 88 to drive the first and second shafts 54 and 56, respectively, at different, predetermined speeds. In the preferred embodiment, the first shaft driving means 86 includes a first gear reduction motor 90 fastened above the lower frame member 74, and having a gear reduction drive 92 to an output shaft 94. A first motor sprocket 96 is mounted to the output shaft 94 rotating at the desired, relatively low speed for first, tubular shaft 54. Sprocket 98 carried on shaft 54 allows rotation of the first shaft 54 at the predetermined speed of output shaft 94 by means of a first chain 100 which bridges sprockets 96 and 98. The second shaft driving means 88 includes a second motor 102 fastened above the lower frame plate 74, a second motor sprocket 104 mounted to the bottom of the shaft of motor 102, and a second shaft sprocket 106. Rotation of the second drive shaft 56 at the predetermined greater speed of motor 102 is accomplished by means of a second chain 108 which bridges sprockets 104 and 106.

In operation, particulate material to be separated into relatively light and heavy components will be introduced into the center of the rotary separator bowl 12 through central opening 28 in guide baffle 18. The material will strike dome 24 and be spread radially outwardly therefrom. With separator bowl 12 being driven at a first, relatively low rotary speed on the order of 100 to 150 r.p.m., and vibrator disc 58 rotating at a relatively high speed within a preferred range of 1700 to 1800 r.p.m., the particulate material will be moved radially outwardly toward peripheral side wall 14 of bowl 12 by centrifugal force. The vibration set up in bowl 12, and therefore in particulate material 26 by unbalanced disc 58, will tend to keep the particles in a relatively fluid state. This enhances their outward movement through centrifugal force derived from the rotation of bowl 12. The material flow thus generated will cause the particles to move outwardly and thence upwardly along inclined side wall 14 of separator bowl 12.

The predetermined speeds at which shafts 54 and 56 rotate, the angular slope or inclination of side wall 14 of bowl 12, and the radial dimension of annular exit zone 34 cooperate in such a way as to permit the centrifugal force inside of bowl 12 to be equal to or slightly in excess of the force of gravity. This permits the particulate material 26 to ascend the inclined side wall 14 and move towards the lower, peripheral exit zone 34 and separator ring 30. The combination of the aforesaid factors, in conjunction with the controlled input rate of material to be separated into bowl 12, insures that relatively heavy material will accumulate against inclined side wall 14 and be discharged at a desired rate through peripheral exit zone 34 into the first accumulation chamber 38. As is indicated by the phantom lines in FIG. 1, lighter material will tend to accumulate on top of the heavier material along inclined side wall 14 and build up under separator ring 30. As the lighter particles continue to accumulate in that manner, they will subsequently flow up past the bottom end of guide baffle 18, and thereafter upwardly along the inclined face of baffle 18 for discharge through upper exit zone 22 into outer collection chamber 44.

The vertical location of second exit zone 34 for relatively heavy particles and the radial dimension of that exit zone are closely controlled so as to insure, in conjunction with the controlled rate of material input to bowl 12, the desired output flow of relatively heavy particles through exit zone 34 and of relatively light material through upper, exit zone 22. This is accomplished by the vertical location of mounting brackets 32 on inclined side wall 14, and by the horizontal extent of separator ring 30. For grain separator applications, the desired grain particles will discharge through lower exit zone 34 into accumulation chamber 38. Lighter weight chaff and undesired foreign particles will discharge through upper exit zone 22 into chamber 44.

Those skilled in the art will readily appreciate that the centrifugal separator disclosed herein provides an efficient and effective means for separating light and heavy components of particulate material, and collecting those components. It is anticipated that various changes may be made in the size, shape, and construction of the separator disclosed herein without departing from the spirit and scope of the invention as defined by the following claims.

What is claimed is:

1. Apparatus for centrifugal separation comprising:

a separator bowl for receiving particulate material to be separated into different weight components, said bowl having an outwardly inclined peripheral wall;

means for rotating said separator bowl at a predetermined speed;

vibrating means in cooperative association with said separator bowl operative to vibrate said bowl as it rotates, whereby material particles deposited in said bowl will be moved by centrifugal force and vibration generally outwardly towards the periphery thereof and thence upwardly along said inclined peripheral wall;

an outwardly inclined, annular guide baffle mounted at an elevated position above the bottom of said separator bowl and projecting above the top of said inclined peripheral wall, the top periphery of said guide baffle defining a first peripheral exit zone for relatively light weight particles flowing upwardly on said inclined peripheral wall and on said guide baffle; and a separator ring attached to said guide baffle and extending outwardly therefrom, said separator ring terminating inwardly from said inclined peripheral wall in spaced apart relation thereto and defining therewith an annular opening comprising a second peripheral exit zone below said first peripheral exit zone for relatively heavy particles.

2. The apparatus for centrifugal separation of claim 1 wherein:

the lower end of said annular guide baffle extends below the upper extremity of said inclined wall of said separator bowl, and said separator ring is mounted on said lower end of said guide baffle and extends outwardly therefrom towards said inclined wall at a location below the upper extremity of said inclined wall.

3. The apparatus for centrifugal separation of claim 1 wherein:

said annular guide baffle is supported at said elevated position by bracket means affixed between said separator ring and said inclined wall of said separator bowl.

4. The apparatus for centrifugal separation of claim 1 wherein:

said annular guide baffle is circular in shape and is supported generally concentric with said separator bowl.

5. The apparatus for centrifugal separation of claim 1 wherein:

said vibrating means comprises a rotary device; and drive means connected to said rotary device and operative to rotate said rotary vibrating device at a second predetermined speed which is in excess of said predetermined speed at which said separator bowl is rotated by a predetermined multiple.

6. Apparatus for centrifugal separation comprising:

a separator bowl for receiving particulate material to be separated into different weight components, said bowl having an outwardly inclined peripheral wall;

first drive means connected to said separator bowl and operative to rotate said bowl at a first determined speed, said first drive means includes a collar attached to the base of said separator bowl and projecting vertically downward from said separator bowl, and also including connecting means attached to said first drive means and projecting horizontally from said first drive means and connected to said collar so that said first drive means is connected to said separator bowl so as to rotate said separator bowl at said first predetermined speed;

means defining separate exit zones at vertically spaced elevations for relatively light and heavy particles adjacent the periphery of said inclined wall;

rotary vibrating means in cooperative association with said separator bowl operative to vibrate said bowl as it rotates and keep the material in said bowl in a fluid state; and second drive means connected to said rotary vibrating means and operative to rotate said vibrating means at a second predetermined speed which is in excess of said first predetermined speed by a predetermined multiple, the relative speeds of said first and second drive means and the outward inclination of said inclined peripheral wall being such that material particles deposited in the middle of said bowl will be moved by centrifugal force and vibration generally outwardly towards the periphery thereof and will ascend said inclined peripheral wall for selective discharge of heavy and light material at lower and higher ones of said exit zones, respectively.

7. The apparatus for centrifugal separation of claim 6 further comprising:

roller bracing means contacting said collar of said first drive means in a circular pattern so that said collar and said roller bracing means cooperate to laterally retain said first drive means.

8. The apparatus for centrifugal separation of claim 6 wherein:

said second drive means rotates said vibrating means at a speed at least ten times that at which said first drive means rotates said separator bowl.

9. Apparatus for centrifugal separation comprising:

a separator bowl for receiving particulate material to be separated into different weight components, said bowl having an outwardly inclined peripheral wall;

first drive means connected to said separator bowl and operative to rotate said bowl at a first predetermined speed;

means defining separate exit zones at vertically spaced elevations for relatively light and heavy particles adjacent the periphery of said inclined peripheral wall;

rotary vibrating means in cooperative association with said separator bowl operative to vibrate said bowl as it rotates and keep the material in said bowl in a fluid state, said rotary vibrating means is an unbalanced disc positioned within said separator bowl; and second drive means connected to said rotary vibrating means and operative to rotate said vibrating means at a second predetermined speed which is in excess of said first predetermined speed by a predetermined multiple, the relative speeds of said first and second drive means and the outward inclination of said inclined peripheral wall being such that material particles deposited in the middle of said bowl will be moved by centrifugal force and vibration generally outwardly towards the periphery thereof and will ascend said inclined peripheral wall for selective discharge of heavy and light material at lower and higher ones of said exit zones, respectively, said second drive means includes a drive shaft connected to said disc.

10. The apparatus for centrifugal separation of claim 9 wherein:

said first drive means comprises a tubular shaft, and said second drive means shaft extends longitudinally within said tubular shaft in concentric alignment therewith.

11. The apparatus for centrifugal separation of claim 9 further comprising:

a dome member covering said unbalanced disc within said separator bowl and separating said disc from particulate material within said bowl.

12. Apparatus for centrifugal separation comprising:

a separator bowl for receiving particulate material to be separated into different weight components, said bowl having an outwardly inclined peripheral wall;

first drive means connected to said separator bowl and operative to rotate said bowl at a first predetermined speed;

means defining separate exit zones at vertically spaced elevations for relatively light and heavy particles adjacent the periphery of said inclined peripheral wall;

rotary vibrating means in cooperative association with said separator bowl operative to vibrate said bowl as it rotates and keep the material in said bowl in a fluid state;

second drive means connected to said rotary vibrating means and operative to rotate said vibrating means at a second predetermined speed by a predetermined multiple, the relative speeds of said first and second drive means and the outward inclination of said inclined peripheral wall being such that material particles deposited in the middle of said bowl will be moved by centrifugal force and vibration generally outwardly towards the periphery thereof and will ascend said inclined peripheral wall for selective discharge of heavy and light material at lower and higher one of said exit zones, respectively; and said separator bowl is supported on a frame assembly at an elevated location, and said first and second drive means comprise first and second elongated drive shafts extending downwardly from said separator bowl and said rotary vibrating means within said frame assembly to points of drive connection with motor means.

* * * * *